US009961465B2

(12) United States Patent
Lan et al.

(10) Patent No.: US 9,961,465 B2
(45) Date of Patent: May 1, 2018

(54) METHOD FOR IMPROVING SPEAKER PERFORMANCE AND TERMINAL DEVICE

(71) Applicant: Huawei Technologies Co., Ltd., Shenzhen (CN)

(72) Inventors: Youying Lan, Shanghai (CN); Weicun Zhou, Shanghai (CN); Peng Li, Shenzhen (CN)

(73) Assignee: HUAWEI TECHNOLOGIES CO., LTD., Shenzhen (CN)

( * ) Notice: Subject to any disclaimer, the term of this patent is extended or adjusted under 35 U.S.C. 154(b) by 0 days. days.

(21) Appl. No.: 15/507,355

(22) PCT Filed: Aug. 29, 2014

(86) PCT No.: PCT/CN2014/085565
§ 371 (c)(1),
(2) Date: Feb. 28, 2017

(87) PCT Pub. No.: WO2016/029448
PCT Pub. Date: Mar. 3, 2016

(65) Prior Publication Data

US 2017/0289715 A1 Oct. 5, 2017

(51) Int. Cl.
*H04R 29/00* (2006.01)
*H04R 27/00* (2006.01)

(52) U.S. Cl.
CPC ..... *H04R 29/001* (2013.01); *H04R 27/00* (2013.01); *H04R 2201/028* (2013.01); *H04R 2420/05* (2013.01); *H04R 2499/11* (2013.01)

(58) Field of Classification Search
CPC ..... H04R 29/001; H04R 27/00; H04R 2201/028; H04R 2420/05; H04R 2420/03; H04R 2499/11
(Continued)

(56) References Cited

U.S. PATENT DOCUMENTS 4,057,689 A * 11/1977 Stallings, Jr. ..... H04R 1/02 181/145
5,797,102 A 8/1998 Hallikainen et al.
(Continued)

FOREIGN PATENT DOCUMENTS

CN 1647582 A 7/2005
CN 1719362 A 1/2006
(Continued)

OTHER PUBLICATIONS

Machine Translation and Abstract of Chinese Publication No. CN104113804, Oct. 22, 2014, 4 pages.
(Continued)

*Primary Examiner* — Jason R Kurr
(74) *Attorney, Agent, or Firm* — Conley Rose, P.C.

(57) ABSTRACT

Embodiments of the present disclosure provide a method for improving speaker performance and a terminal device, when a speaker is being driven, an algorithm parameter that matches the speaker is selected, to resolve a problem that adjustment and control performance is reduced because of a difference in speaker models, and can effectively improve performance of a speaker. The method includes obtaining an identity of a speaker, where the identity is used to identify the speaker; obtaining an algorithm parameter corresponding to the speaker from a preset algorithm parameter library according to the identity of the speaker, where the preset algorithm parameter library comprises algorithm parameters of speakers of at least two models; sending the algorithm parameter corresponding to the speaker to a smart speaker power amplifier module, so that the smart speaker power amplifier module drives the speaker according to the algorithm parameter corresponding to the speaker.

8 Claims, 5 Drawing Sheets

(58) Field of Classification Search
USPC ..... 381/58, 59
See application file for complete search history.

(56) References Cited

U.S. PATENT DOCUMENTS

| | | | | |
|---|---|---|---|---|
| 6,385,322 | B1 * | 5/2002 | Mietling | H04R 3/04 381/59 |
| 6,859,538 | B1 * | 2/2005 | Voltz | H04R 3/04 381/101 |
| 9,020,153 | B2 * | 4/2015 | Britt, Jr. | H04S 7/308 381/58 |
| 2005/0141724 | A1 | 6/2005 | Hesdahl et al. | |
| 2009/0103754 | A1 | 4/2009 | Gottschalk et al. | |
| 2009/0147134 | A1 * | 6/2009 | Iwamatsu | H04N 5/60 348/484 |
| 2012/0300948 | A1 | 11/2012 | Li et al. | |
| 2014/0010381 | A1 * | 1/2014 | Doy | H04R 29/00 381/59 |
| 2015/0156588 | A1 * | 6/2015 | Kyriakakis | H04R 3/04 381/98 |
| 2015/0221188 | A1 | 8/2015 | Wan | |

FOREIGN PATENT DOCUMENTS

| | | | |
|---|---|---|---|
| CN | 103500574 | A | 1/2014 |
| CN | 103916771 | A | 7/2014 |
| CN | 104113804 | A | 10/2014 |
| CN | 104113805 | A | 10/2014 |
| WO | 0119060 | A1 | 3/2001 |

OTHER PUBLICATIONS

Machine Translation and Abstract of Chinese Publication No. CN104113805, Oct. 22, 2014, 5 pages.

Foreign Communication From A Counterpart Application, European Application No. 14900986.2, Extended European Search Report dated Jun. 19, 2017, 8 pages.

Foreign Communication From A Counterpart Application, PCT Application No. PCT/CN2014/085565, English Translation of International Search Report dated Jun. 4, 2015, 2 pages.

Foreign Communication From A Counterpart Application, PCT Application No. PCT/CN2014/085565, English Translation of Written Opinion dated Jun. 4, 2015, 6 pages.

* cited by examiner

METHOD FOR IMPROVING SPEAKER PERFORMANCE AND TERMINAL DEVICE

CROSS-REFERENCE TO RELATED APPLICATIONS

This application is a national stage of International Application No. PCT/CN2014/085565, filed on Aug. 29, 2014, which is hereby incorporated by reference in its entirety.

TECHNICAL FIELD

Embodiments of the present disclosure relate to the electric acoustic technologies, and in particular, to a method for improving speaker performance and a terminal device.

BACKGROUND

With continuous development of technologies, replacement and upgrade terminal devices are faster, and audio performance, used as an important performance indicator of the terminal devices, is an important field in technology development and update. A combination of a smart power amplifier (Smart PA) chip and a speaker (SPK) is a main development direction in the industry, and can effectively improve a series of performance of the terminal device, such as loudness and sound quality that are of an external audio. A feature change of the SPK is related to a frequency/impedance curve, and the smart PA can measure in real time a voltage and a current that are output, so as to obtain the frequency/impedance curve of the SPK by means of calculation. The smart PA can obtain statuses such as current amplitude and temperature of the speaker by means of calculation according to a pre-established algorithm and a preset algorithm parameter, and can further predict future amplitude of the speaker by calculating an input signal. Therefore, performance of the SPK can be effectively adjusted, for example, increasing volume, improving sound quality, and controlling temperature. Adjusting and controlling the SPK by the smart PA depends on the preset algorithm parameter. To enable the smart PA to accurately control real-time output of the SPK to reach a best effect, an audio engineer needs to repeatedly perform debugging according to original performance of the SPK to determine the preset algorithm parameter.

In practice, SPKs supplied by different suppliers have different models, that is, the SPKs supplied by the different suppliers are different in physical performance. When a smart PA needs to drive SPK components of different models, in an existing technical solution, the smart PA adjusts and controls the SPKs in real time by using a unique preset algorithm parameter. Because performance of adjustment and control of an SPK by the smart PA greatly depends on original performance of the SPK, the unique preset algorithm parameter cannot match the SPK of all models, and the smart PA cannot adjust and control the SPKs of all models in a most proper manner. Therefore, the performance of the SPK is substantially reduced, and even cannot meet an actual requirement.

SUMMARY

Embodiments of the present disclosure provide a method for improving speaker performance and a terminal device, so as to resolve, when performance of a speaker is being adjusted, a problem that adjustment and control performance is reduced because of a difference in speaker models, and can effectively improve the performance of the speaker.

According to a first aspect, the embodiments of the present disclosure provide a method for improving speaker performance, where the method includes obtaining an identity of a speaker, where the identity is used to identify the speaker, obtaining an algorithm parameter corresponding to the speaker from a preset algorithm parameter library according to the identity of the speaker, where the preset algorithm parameter library includes algorithm parameters of speakers of at least two models, and sending the algorithm parameter corresponding to the speaker to a smart speaker power amplifier module, so that the smart speaker power amplifier module drives the speaker according to the algorithm parameter corresponding to the speaker.

With reference to the first aspect, in a first possible implementation manner, the obtaining an identity of the speaker includes reading an identification module disposed on the speaker to obtain the identity of the speaker.

With reference to the first possible implementation manner of the first aspect, in a second possible implementation manner, the identification module includes a first pin and a second pin that are disposed on the speaker, where a short-circuit connection between the first pin and the second pin that are on the speaker or a disconnection between the first pin and the second pin that are on the speaker is used as the identity of the speaker.

With reference to the first possible implementation manner of the first aspect, in a third possible implementation manner, the identification module includes a first pin, a second pin, and a resistor that are disposed on the speaker, where the resistor is connected between the first pin and the second pin, and a resistance value of the resistor is used as the identity of the speaker.

With reference to the second or the third possible implementation manner of the first aspect, in a fourth possible implementation manner, when a speaker box of the speaker has a metal housing, the metal housing of the speaker box is used as the first pin or the second pin.

According to a second aspect, the embodiments of the present disclosure provide a terminal device, where the terminal device includes a first obtaining unit, configured to obtain an identity of a speaker, where the identity is used to identify the speaker, a second obtaining unit, configured to obtain an algorithm parameter corresponding to the speaker from a preset algorithm parameter library according to the identity of the speaker, where the preset algorithm parameter library includes algorithm parameters of speakers of at least two models, and a sending unit, configured to send the algorithm parameter corresponding to the speaker to a smart speaker power amplifier module, so that the smart speaker power amplifier module drives the speaker according to the algorithm parameter corresponding to the speaker.

With reference to the second aspect, in a first possible implementation manner, the first obtaining unit is configured to read an identification module disposed on the speaker to obtain the identity of the speaker.

With reference to the first possible implementation manner of the second aspect, in a second possible implementation manner, the identification module includes a first pin and a second pin that are disposed on the speaker, where a short-circuit connection between the first pin and the second pin that are on the speaker or a disconnection between the first pin and the second pin that are on the speaker is used as the identity of the speaker.

With reference to the first possible implementation manner of the second aspect, in a third possible implementation manner, the identification module includes a first pin, a second pin, and a resistor that are disposed on the speaker, where the resistor is connected between the first pin and the second pin, and a resistance value of the resistor is used as the identity of the speaker.

With reference to the second or the third possible implementation manner of the second aspect, in a fourth possible implementation manner, when a speaker box of the speaker has a metal housing, the metal housing of the speaker box is used as the first pin or the second pin.

According to a third aspect, the embodiments of the present disclosure provide a terminal device, where the terminal device includes a smart speaker power amplifier module, an application processor, and a speaker, where an identification module is disposed on the speaker, and the identification module is configured to identify the speaker, the terminal device further includes: a memory, configured to store algorithm parameters of speakers of at least two models, the application processor is configured to read information about the identification module to obtain an identity of the speaker, obtain, according to the identity, an algorithm parameter corresponding to the speaker from the memory, and send the corresponding algorithm parameter to the smart speaker power amplifier module, and the smart speaker power amplifier module is configured to drive the speaker according to the algorithm parameter sent by the application processor.

With reference to the third aspect, in a first possible implementation manner, the identification module includes a first pin and a second pin that are disposed on the speaker, where a short-circuit connection between the first pin and the second pin that are on the speaker or a disconnection between the first pin and the second pin that are on the speaker is used as the identity of the speaker.

With reference to the third aspect, in a second possible implementation manner, the identification module includes a first pin, a second pin, and a resistor that are disposed on the speaker, where the resistor is connected between the first pin and the second pin, and a resistance value of the resistor is used as the identity of the speaker.

With reference to the first or the second possible implementation manner of the third aspect, in a third possible implementation manner, when a speaker box of the speaker has a metal housing, the metal housing of the speaker box is used as the first pin or the second pin.

According to the method for improving speaker performance and the terminal device that are provided in the embodiments of the present disclosure, an identity of a speaker is first obtained, where the identity is used to identify the speaker, then an algorithm parameter corresponding to the speaker is obtained from a preset algorithm parameter library according to the identity of the speaker, where the preset algorithm parameter library includes algorithm parameters of speakers of at least two models, and finally, the algorithm parameter corresponding to the speaker is sent to a smart speaker power amplifier module, so that the smart speaker power amplifier module drives the speaker according to the algorithm parameter corresponding to the speaker. Most suitable algorithm parameters are obtained in advance for speakers of different models by means of debugging, so that when a speaker is being driven, an algorithm parameter that matches the speaker is selected, to resolve a problem that adjustment and control performance is reduced because of a difference in speaker models, and can effectively improve performance of a speaker.

BRIEF DESCRIPTION OF DRAWINGS

To describe the technical solutions in the embodiments of the present disclosure or in the prior art more clearly, the following briefly describes the accompanying drawings required for describing the embodiments or the prior art. The accompanying drawings in the following description show some embodiments of the present disclosure, and persons of ordinary skill in the art may still derive other drawings from these accompanying drawings without creative efforts.

DESCRIPTION OF EMBODIMENTS

To make the objectives, technical solutions, and advantages of the embodiments of the present disclosure clearer, the following clearly and completely describes the technical solutions in the embodiments of the present disclosure with reference to the accompanying drawings in the embodiments of the present disclosure. The described embodiments are some but not all of the embodiments of the present disclosure. All other embodiments obtained by persons of ordinary skill in the art based on the embodiments of the present disclosure without creative efforts shall fall within the protection scope of the present disclosure.

Figure 1:
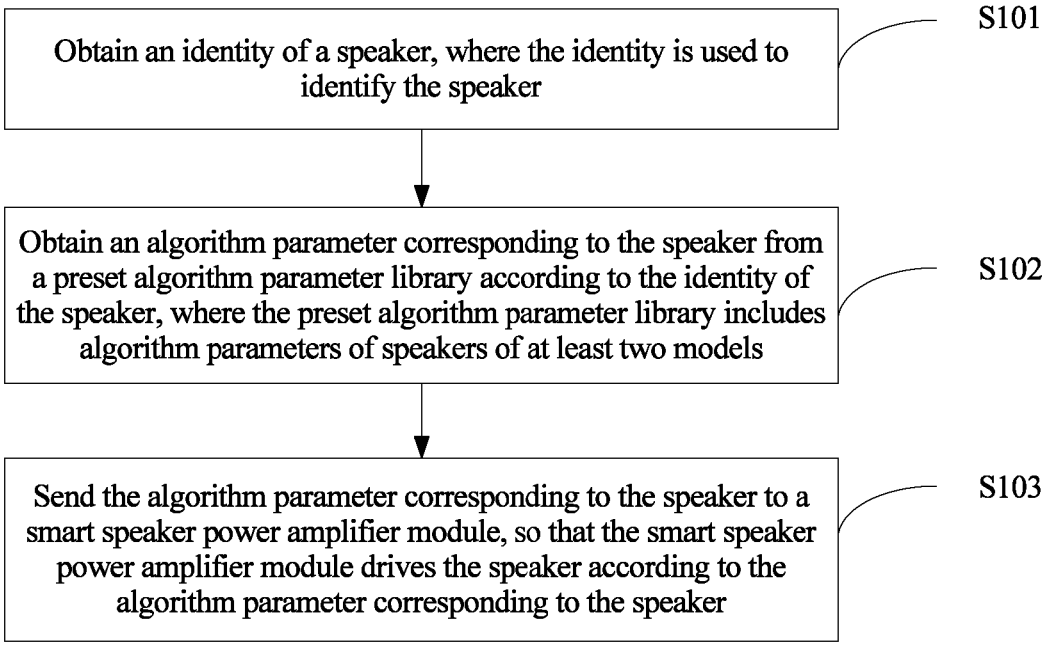
FIG. 1 is a schematic flowchart of a method for improving speaker performance according to an embodiment of the present disclosure.

An embodiment of the present disclosure provides a method for improving speaker performance, that is, a method for obtaining a parameter corresponding to a speaker. As shown in FIG. 1, the method includes the following steps.

S101. Obtain an identity of a speaker, where the identity is used to identify the speaker.

In a driving algorithm of a smart speaker power amplifier module, speakers of different models are corresponding to different algorithm parameters, and the smart speaker power amplifier module may be a smart power amplifier chip, that is, a smart PA.

It should be noted that in the technical solutions in this embodiment of the present disclosure, identities used to distinguish models are set on speakers of different models supplied by various suppliers, and a unified criterion needs to be formed for setting the identities, so as to facilitate management by a terminal manufacturer purchasing the speakers.

A processing chip of a terminal device may read an identification module disposed on the speaker to obtain the identity of the speaker.

When there are only two models of speakers, the identification module disposed on the speaker by a supplier may include two pins, a first pin and a second pin, that are additionally added to the speaker, other than two pins required for power supply of the speaker.

A short-circuit connection (that is, a short-circuit state) between the first pin and the second pin is used as a first identity of a speaker of a first model. A disconnection between the first pin and the second pin is used as a second identity of a speaker of a second model.

When there are at least two models of speakers, the identification module disposed on the speaker by a supplier may include two pins, a first pin and a second pin, and a resistor that are additionally added to the speaker.

The resistor is connected between the first pin and the second pin, and a resistance value of the resistor is used as the identity of the speaker.

In addition, it is worth noting that when a speaker box of the speaker has a metal housing, the metal housing of the speaker box may be used as the first pin or the second pin. A decrease of one pin can reduce occupation of internal circuit space of the terminal device.

Correspondingly, when there are only two models of speakers, the identity of the speaker is determined as the first identity if the processing chip of the terminal device reads a short-circuit connection between the first pin and the second pin; or, the identity of the speaker is determined as the second identity if the processing chip of the terminal device reads a disconnection between the first pin and the second pin.

Alternatively, when there are at least two models of speakers, the processing chip of the terminal device obtains the identity of the speaker according to the read resistance value of the resistor connected between the first pin and the second pin.

It should be further noted herein that the implementation manners of the foregoing identification module are merely examples for exemplary description, and a function of the identification module may be further implemented by using another implementation manner. For example, an identity identification chip (similar to an identity identification chip in an ID card) is disposed on the speaker, and then the terminal device can obtain the identity of the speaker by reading information about the chip. Specific implementation manners are not listed one by one herein, and a person skilled in the art may select a suitable implementation manner in practice according to a requirement.

S102. Obtain an algorithm parameter corresponding to the speaker from a preset algorithm parameter library according to the identity of the speaker, where the preset algorithm parameter library includes algorithm parameters of speakers of at least two models.

It should be noted that in the technical solutions provided in this embodiment of the present disclosure, for speakers of different models of various suppliers, an audio engineer has obtained in advance algorithm parameters corresponding to the speakers of all the models by means of debugging, and classifies the algorithm parameters and stores the classified algorithm parameters in the algorithm parameter library.

A processing module of the terminal device, such as a processing chip, determines a model of the speaker according to the identity of the speaker, and obtains the algorithm parameter corresponding to the speaker of the model from the preset algorithm parameter library.

S103. Send the algorithm parameter corresponding to the speaker to a smart speaker power amplifier module, so that the smart speaker power amplifier module drives the speaker according to the algorithm parameter corresponding to the speaker.

The processing chip of the terminal device sends the algorithm parameter of the speaker to the smart PA, and the smart PA drives the speaker according to the algorithm parameter and the driving algorithm.

It should be further noted that, in the technical solutions provided in this embodiment of the present disclosure, algorithm parameters that match speakers of different models are obtained in advance for the speakers of different models by means of debugging, and are stored in an algorithm parameter library; a processing chip of a terminal device identifies an identity of a speaker to determine a model of the speaker, and then selects an algorithm parameter that matches the speaker from the stored algorithm parameter library; and a smart power amplifier can exploit maximum performance of the speaker by driving the speaker by using the algorithm parameter. Compared with the prior art in which an audio engineer can give only one set of balanced algorithm parameters because the audio engineer needs to consider exploiting performance of speakers of different models in a balanced manner to a greatest extent, the technical solutions in this embodiment of the present disclosure are well compatible with the speakers of different models and easy to implement, and can effectively improve performance of a speaker.

According to the method for improving speaker performance provided in this embodiment of the present disclosure, a terminal device first obtains an identity of a speaker, where the identity is used to identify the speaker; then obtains an algorithm parameter corresponding to the speaker from a preset algorithm parameter library according to the identity of the speaker, where the preset algorithm parameter library includes algorithm parameters of speakers of at least two models; and finally, sends the algorithm parameter corresponding to the speaker to a smart speaker power amplifier module, so that the smart speaker power amplifier module drives the speaker according to the algorithm parameter corresponding to the speaker. Most suitable algorithm parameters are obtained in advance for speakers of different models by means of debugging, so that when a speaker is being driven, an algorithm parameter that matches the speaker is selected, to resolve a problem that adjustment and control performance is reduced because of a difference in speaker models, and can effectively improve performance of a speaker.

Figure 2:
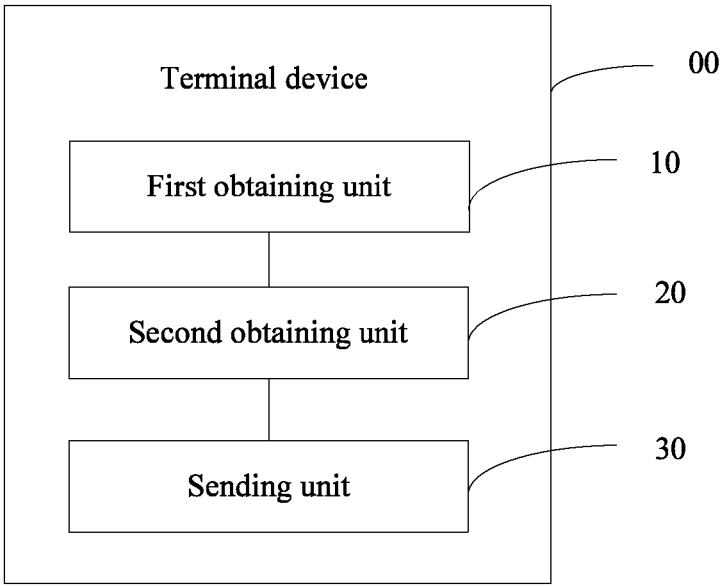
FIG. 2 is a first schematic structural diagram of a terminal device according to an embodiment of the present disclosure.

An embodiment of the present disclosure provides a terminal device 00. As shown in FIG. 2, the terminal device 00 includes a first obtaining unit 10, configured to obtain an identity of a speaker, where the identity is used to identify the speaker, a second obtaining unit 20, configured to obtain an algorithm parameter corresponding to the speaker from a preset algorithm parameter library according to the identity of the speaker, where the preset algorithm parameter library includes algorithm parameters of speakers of at least two models, and a sending unit 30, configured to send the algorithm parameter corresponding to the speaker to a smart speaker power amplifier module, so that the smart speaker power amplifier module drives the speaker according to the algorithm parameter corresponding to the speaker.

Optionally, the first obtaining unit may be configured to read an identification module disposed on the speaker to obtain the identity of the speaker.

Optionally, the identification module includes a first pin and a second pin that are disposed on the speaker.

A short-circuit connection between the first pin and the second pin that are on the speaker or a disconnection between the first pin and the second pin that are on the speaker is used as the identity of the speaker.

Optionally, the identification module includes a first pin, a second pin, and a resistor that are disposed on the speaker.

The resistor is connected between the first pin and the second pin, and a resistance value of the resistor is used as the identity of the speaker.

Preferably, when a speaker box of the speaker has a metal housing, the metal housing of the speaker box is used as the first pin or the second pin.

This embodiment is used to implement the foregoing method embodiment. For operating processes and operating principles of the units in this embodiment, reference is made to the descriptions in the foregoing method embodiment, and details are not described herein again.

It should be noted that in the terminal device 00 provided in this embodiment of the present disclosure, the first obtaining unit 10, the second obtaining unit 20, and the sending unit 30 may be integrated into an individually disposed processor; or may be implemented by integrating into a processor of the terminal device; in addition, may also be stored in a memory of the terminal device in a form of program code, and a processor of the terminal device invokes the program code and performs functions of the foregoing units. The processor herein may be a central processing unit (CPU) or an application-specific integrated circuit (ASIC), or is configured as one or more integrated circuits for implementing this embodiment of the present disclosure.

The terminal device provided in this embodiment of the present disclosure first obtains an identity of the speaker, where the identity is used to identify the speaker; then obtains an algorithm parameter corresponding to the speaker from a preset algorithm parameter library according to the identity of the speaker, where the preset algorithm parameter library includes algorithm parameters of speakers of at least two models; and finally sends the algorithm parameter corresponding to the speaker to a smart speaker power amplifier module, so that the smart speaker power amplifier module drives the speaker according to the algorithm parameter corresponding to the speaker. Most suitable algorithm parameters are obtained in advance for speakers of different models by means of debugging, so that when a speaker is being driven, an algorithm parameter that matches the speaker is selected, to resolve a problem that adjustment and control performance is reduced because of a difference in speaker models, and can effectively improve performance of a speaker.

Figure 3:
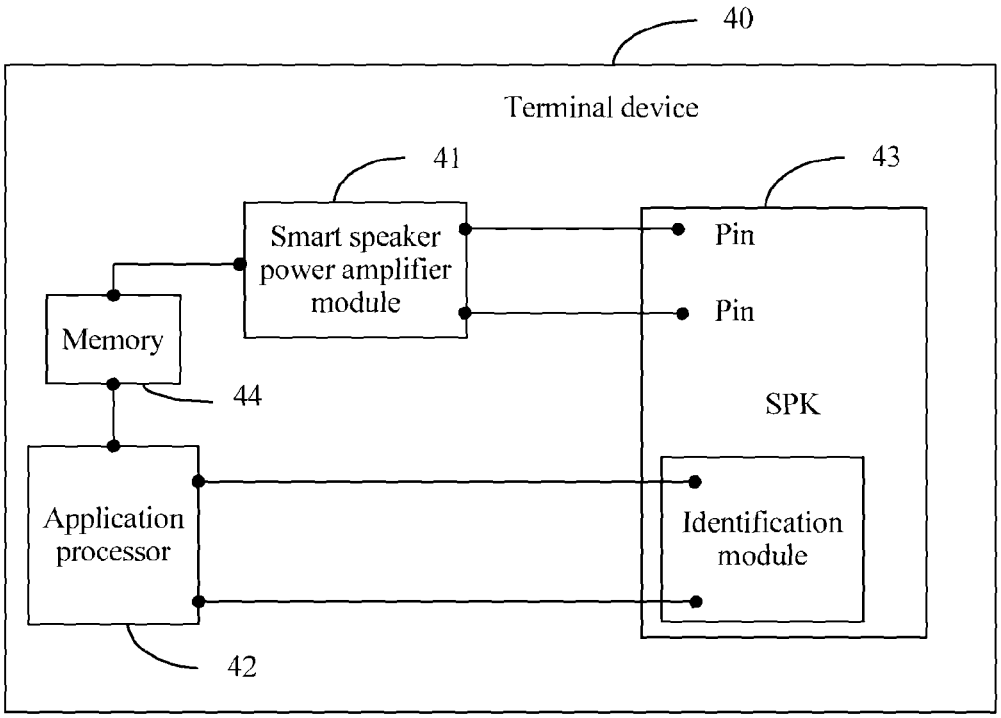
FIG. 3 is a second schematic structural diagram of a terminal device according to an embodiment of the present disclosure.

An embodiment of the present disclosure further provides a terminal device 40. As shown in FIG. 3, the terminal device 40 includes a smart speaker power amplifier module 41, an application processor (AP) 42, and a speaker 43; and further includes a memory 44.

An identification module is disposed on the speaker 43, and the identification module is configured to identify the speaker.

In a driving algorithm of the smart speaker power amplifier module 41, speakers of different models are corresponding to different algorithm parameters, and the smart speaker power amplifier module 41 may be a smart power amplifier chip, that is, a smart PA.

The memory 44 is configured to store algorithm parameters of speakers of at least two models.

The application processor 42 is configured to read information about the identification module on the speaker 43 to obtain an identity of the speaker; obtain, according to the identity, an algorithm parameter corresponding to the speaker from the memory 44; and send the corresponding algorithm parameter to the smart speaker power amplifier module 41.

The smart speaker power amplifier module 41 is configured to drive the speaker 43 according to the algorithm parameter sent by the application processor 42.

Optionally, the identification module on the speaker 43 includes a first pin and a second pin that are disposed on the speaker 43.

A short-circuit connection between the first pin and the second pin that are on the speaker 43 or a disconnection between the first pin and the second pin that are on the speaker 43 is used as the identity of the speaker 43.

Optionally, the identification module on the speaker 43 includes a first pin, a second pin, and a resistor that are disposed on the speaker 43.

The resistor is connected between the first pin and the second pin, and a resistance value of the resistor is used as the identity of the speaker 43.

When a speaker box of the speaker has a metal housing, the metal housing of the speaker box is used as the first pin or the second pin.

It should be noted that in actual implementation, the memory 44 and the application processor 42 or another component of the terminal device may be integrated together, or the memory 44 may be disposed individually. The memory 44 is merely configured to store an algorithm parameter of the driving algorithm. Manners of disposing and implementing the memory 44 are not limited in this embodiment of the present disclosure.

The terminal device provided in this embodiment of the present disclosure can match speakers of multiple models, and select an algorithm parameter that matches a speaker when the speaker is being driven, which avoids reducing adjustment and control performance because of a difference in speaker models, and can effectively improve performance of a speaker.

To make a person skilled in the art more clearly understand the technical solutions provided in this embodiment of the present disclosure, the following describes the technical solutions in details by using specific embodiments. A smart power amplifier chip smart PA is used as an example of the smart speaker power amplifier module.

Figure 4:
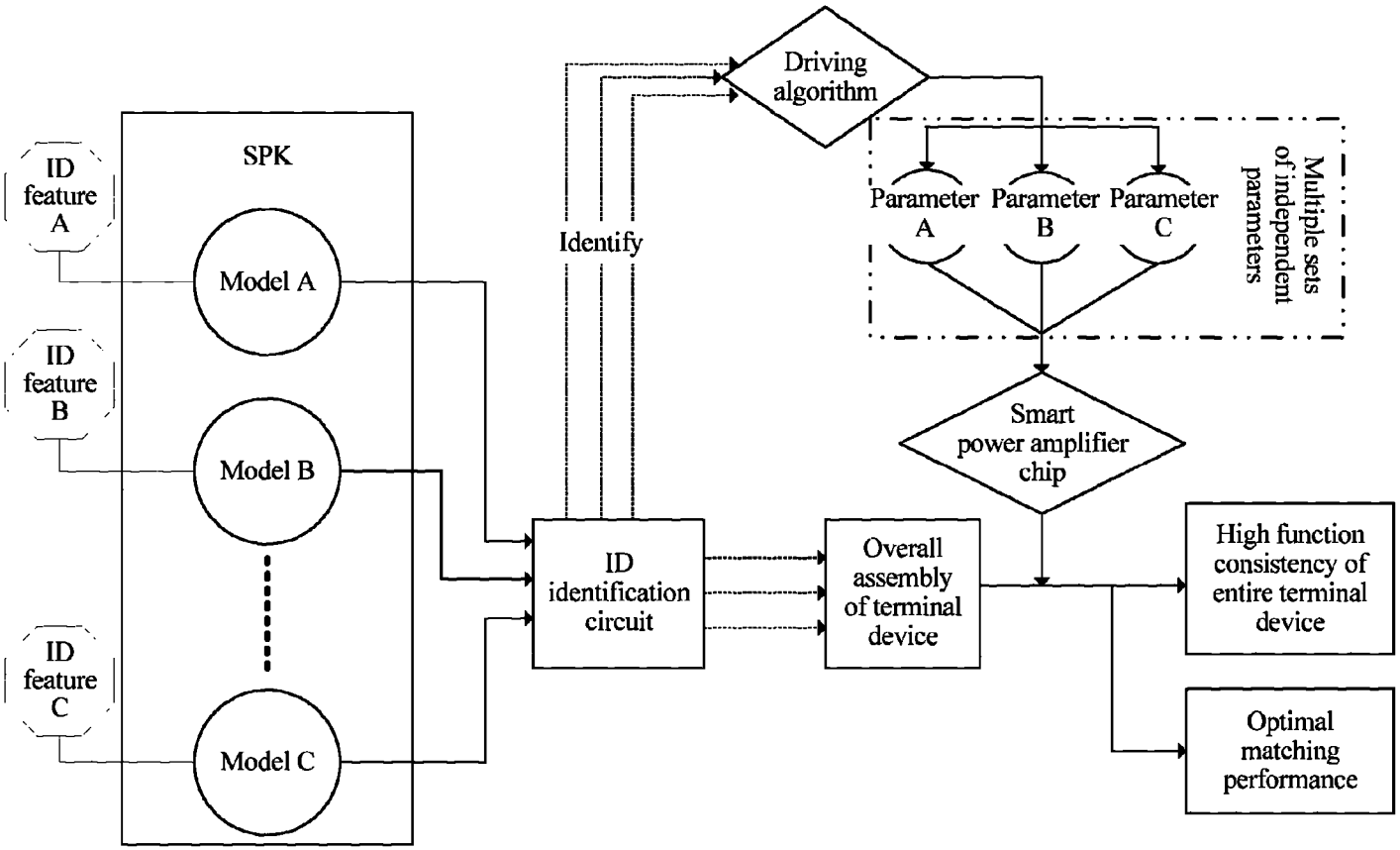
FIG. 4 is a first schematic diagram of an internal operating process of a terminal device according to an embodiment of the present disclosure.

According to the technical solution in this embodiment of the present disclosure, as shown in FIG. 4, during overall design of a terminal device, to enable the terminal device to automatically identify different models of internal SPK components, so as to allocate different algorithm parameters to the smart PA, an audio engineer negotiates with SPK suppliers to associate identities with corresponding suppliers, different identities (ID) such as an ID feature A, an ID feature B, and an ID feature C in FIG. 4 are pre-implanted into SPK components of different models (such as a model A, a model B, and a model C in FIG. 4), and corresponding numbers are given in a driving algorithm of the smart PA. During working, the terminal device reads an ID of an SPK component by using an ID identification circuit on hardware, where IDs are mainly represented as different input resistance values; and identifies different numbers according to the resistance values, and invokes, according to the numbers, a set of algorithm parameters corresponding to the SPK from an algorithm parameter library obtained by an audio engineer in advance by means of debugging, so that the smart PA controls the SPK in a high matching degree.

In actual implementation, ID implantation may be: deriving two additional ID pins other than two pins required for power supply of an SPK. For SPKs of different models, different circuit connection manners that are preset between the two ID pins are used as IDs of the SPKs, external features of the IDs are represented as different resistances, and the resistances are read after a hardware circuit is connected, so as to determine a model of the SPK.

In addition, ID implantation and ID identification are classified into two types according to whether a speaker box housing of the SPK has metal material. Each type includes two solutions: two models of SPKs and at least two models of SPKs.

I. The speaker box housing of the SPK is a non-metal housing

1. There are two models of SPK components: ID implantation and ID identification are exemplarily shown in FIG. 5.

When there are two models of SPK components, a short-circuit connection and a disconnection that are used as connections between two ID pins are respectively used to identify a model A and a model B, and in actual circuit implementation, one ID pin is grounded, and the other one is connected to a voltage of 1.8 V; in this case, the terminal device may read a level between the two ID pins by using a General Purpose Input/Output (GPIO) port, where a high level is read when the two ID pins are disconnected and a low level is read when the two ID pins are in a short-circuit connection, which effectively distinguishes an SPK of the model A from an SPK of the model B.

2. There are at least two models of SPK components: ID implantation and ID identification are exemplarily shown in FIG. 6.

Compared with a case in which there are two models of SPK components, when there are two models of SPK components, a difference is that two manners that are a short-circuit connection or a disconnection are not simply used again between two ID pins, but instead, an ID identification resistor is connected, and different models of SPKs are distinguished according to a resistance value of the connected ID identification resistor. In actual circuit implementation, one ID pin is grounded, and the other one is connected to a voltage of 1.8 V; in this case, the terminal device reads different levels by using an analog-to-digital converter (A/D converter, ADC) port, so as to classify SPKs of multiple models.

It is worth noting that when there are two models of SPK components, the two models are distinguished by using a manner of a short-circuit connection and a disconnection that are between two ID pins, and in this implementation manner, stability is the highest and available GPIO port resources are abundant. When there are at least two models of SPK components, various models are distinguished by using a manner of connecting an identification resistor between two the ID pins; and this implementation manner is easily implemented, and in this implementation manner, an identification function is powerful, identification complexity is minimized, and efficiency of controlling an ADC port is high.

Figure 5:
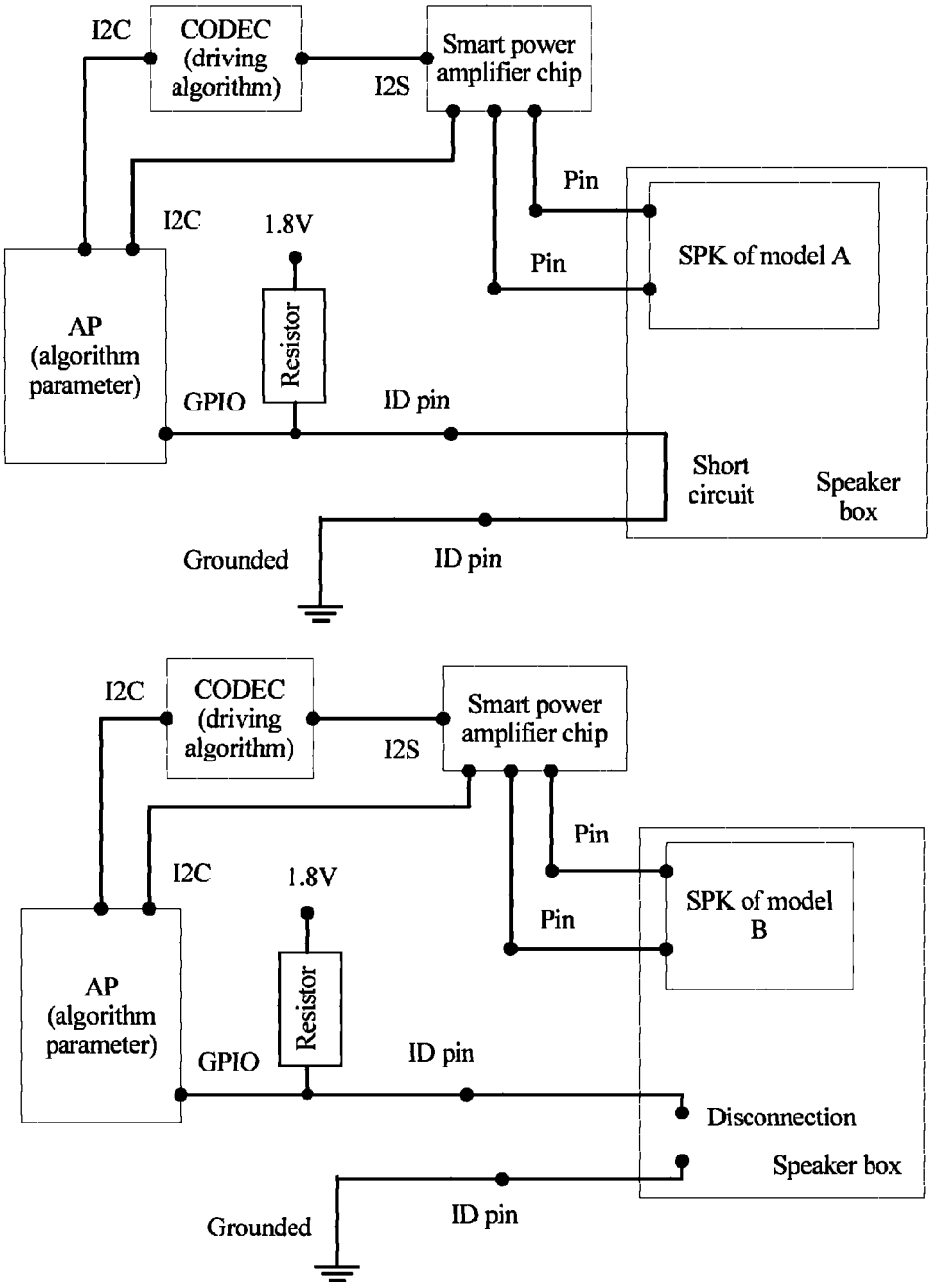
FIG. 5 is a second schematic diagram of an internal operating process of a terminal device according to an embodiment of the present disclosure.
Figure 6:
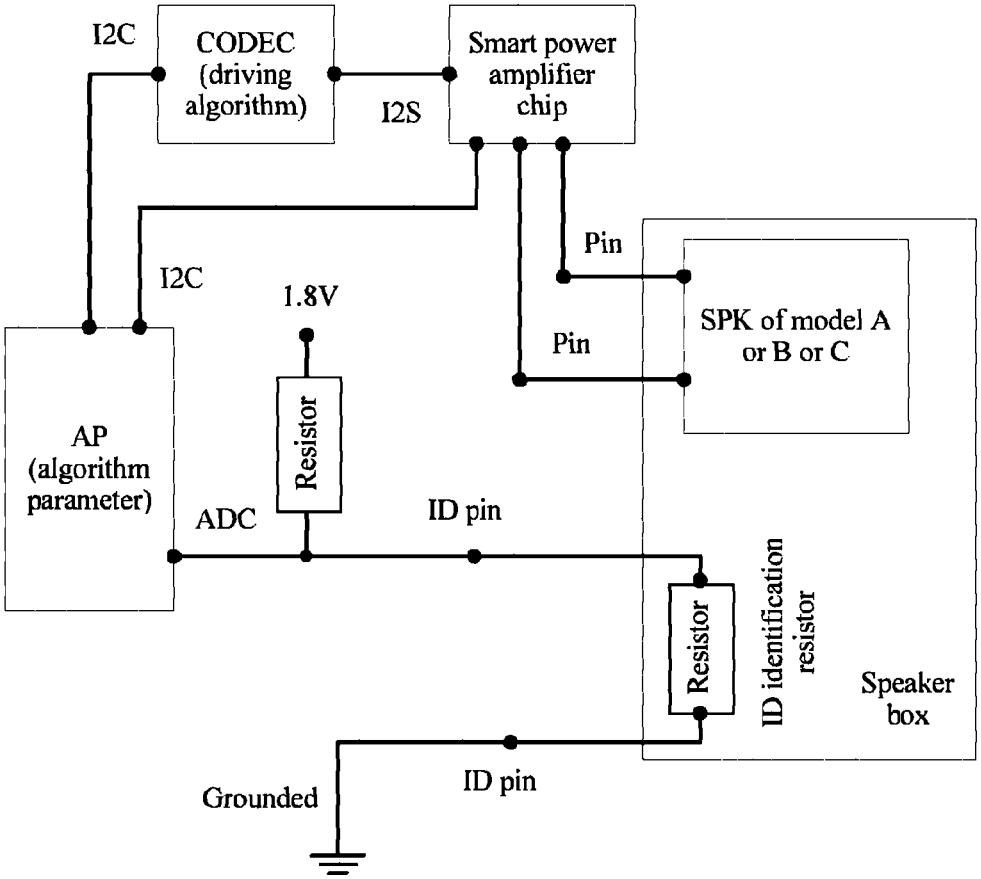
FIG. 6 is a third schematic diagram of an internal operating process of a terminal device according to an embodiment of the present disclosure.

With reference to FIG. 5 and FIG. 6, an operating process of a circuit of a terminal device is exemplarily described:

1. After the entire terminal device starts, a main chip AP reads a level between two ID pins on an SPK by using a GPIO port.

2. A software program stored in the AP determines a model of the SPK according to the read level, and invokes a set of algorithm parameters corresponding to the SPK of the model from multiple sets of prestored standby parameters according to the model of the SPK.

3. The AP delivers, by using an Inter-Integrated Circuit ($I^2C$, a two-line serial bus developed by Philips Ltd.) control port, the invoked algorithm parameters to a smart PA algorithm program stored in a coder-decoder (CODEC), so that the algorithm program loads the parameters to start an algorithm; and the AP monitors an operating status of the smart PA.

It should be noted that in this embodiment of the present disclosure, a driving algorithm of the smart PA is stored in the CODEC, and an algorithm parameter is stored in the main chip AP, which are merely exemplary herein. In actual implementation, a skilled person may select suitable chips to store the driving algorithm and the algorithm parameters according to an actual requirement.

4. After starting the driving algorithm according to the algorithm parameters, the CODEC transports, to the smart PA by using an Inter-IC Sound ($I^2S$, a bus standard formulated by Philips Ltd. for audio data transmission between digital audio devices) data port, an audio signal processed by using the driving algorithm.

5. Finally, the smart PA drives, by using the received audio signal, the SPK to make a sound.

II. The speaker box housing of the SPK is a metal housing.

Because a development trend of an entire terminal device is becoming thinner, and a speaker box of an SPK tends to be designed to be thinner, in an SPK encapsulation technique, a steel sheet material is generally used for a speaker box to reduce housing thickness, and can effectively increase a volume of the speaker box to improve performance. Because the speaker box of the SPK has a metal housing, the metal housing is grounded, and replaces a pin of the foregoing two ID pins that is grounded. Therefore, only one pin needs to be added to a circuit board of the SPK, and more resources are saved. Generally, the metal housing may be grounded by touching a metal support inside the terminal device by using a material such as conductive foam.

It should be noted that an operating process of a circuit of the terminal device is the same as the foregoing process shown in FIG. 5 and FIG. 6, and details are not described herein again.

Finally, it should be further noted that the foregoing ID pins may be implemented inside or outside the SPK by using multiple manners, such as a spring plate, a zero insertion force (Zero Insertion Force, ZIF) socket, and a broad to broad connector (BTB), small space is occupied, circuit design is simple, a structure requirement is low, and a more suitable design is implemented in practical according to a model of the SPK.

It may be found, from the foregoing detailed description of the technical solutions provided in the embodiments of the present disclosure, that the technical solutions provided in the embodiments of the present disclosure may bring the following beneficial effects:

(1) An overall design of a terminal device is simplified: SPKs, within an SPK performance requirement range, of different models of multiple suppliers can be accepted, and it helps a terminal device design vendor control costs.

(2) Debugging of the terminal device is simplified: Debugging only needs to be independently performed for SPKs of various models separately to obtain most suitable algorithm parameters, and multiple sets of algorithm parameters match SPKs of multiple models, so as to exploit optimal performance of the SPKs.

(3) Risk control is effective: When a problem occurs in an SPK that is of one model and supplied by a single supplier, an algorithm parameter of the SPK may be independently adjusted without affecting performance of a product from another supplier.

(4) Maintenance of the terminal device is simplified: When an SPK component needs to be fixed or replaced, the SPK can be replaced by any product from a supplier, and a system of the terminal device can automatically identify a model of an SPK without manually adjusting an algorithm parameter.

(5) Performance reliability and performance consistency of the entire terminal device are improved and optimal performance are reached.

The terminal device in the foregoing technical solutions provided in the embodiments of the present disclosure includes a mobile phone, a tablet computer, a personal computer, and various terminals with an audio and video play function.

In the several embodiments provided in the present disclosure, it should be understood that the disclosed apparatus and method may be implemented in other manners. For example, the described apparatus embodiment is merely exemplary. For example, the unit division is merely logical function division and may be other division in actual implementation. For example, a plurality of units or components may be combined or integrated into another system, or some features may be ignored or not performed. In addition, the displayed or discussed mutual couplings or direct couplings or communication connections may be implemented by using some interfaces. The indirect couplings or communication connections between the apparatuses or units may be implemented in electronic, mechanical, or other forms.

The units described as separate parts may or may not be physically separate, and parts displayed as units may or may not be physical units, may be located in one position, or may be distributed on a plurality of network units. Some or all of the units may be selected according to actual needs to achieve the objectives of the solutions of the embodiments.

In addition, functional units in the embodiments of the present disclosure may be integrated into one processing unit, or each of the units may exist alone physically, or two or more units are integrated into one unit. The integrated unit may be implemented in a form of hardware, or may be implemented in a form of hardware in addition to a software functional unit.

When the foregoing integrated unit is implemented in a form of a software functional unit, the integrated unit may be stored in a computer-readable storage medium. The software functional unit is stored in a storage medium and includes several instructions for instructing a computer device (which may be a personal computer, a server, or a network device) or a processor (processor) to perform some of the steps of the methods described in the embodiments of the present disclosure. The foregoing storage medium includes: any medium that can store program code, such as a universal serial bus (USB) flash drive, a removable hard disk, a read-only memory (ROM), a random access memory (RAM), a magnetic disk, or an optical disc.

It may be clearly understood, by a person skilled in the art, that for the purpose of convenient and brief description, division of the foregoing functional modules is taken as an example for illustration. In actual application, the foregoing functions can be allocated to different functional modules and implemented according to a requirement, that is, an inner structure of an apparatus is divided into different functional modules to implement all or some of the functions described above. For a detailed working process of the foregoing apparatus, reference may be made to a corresponding process in the foregoing method embodiments, and details are not described herein again.

Persons of ordinary skill in the art may understand that all or some of the steps of the method embodiments may be implemented by a program instructing relevant hardware. The program may be stored in a computer-readable storage medium. When the program runs, the steps of the method embodiments are performed. The foregoing storage medium includes: any medium that can store program code, such as a ROM, a RAM, a magnetic disk, or an optical disc.

Finally, it should be noted that the foregoing embodiments are merely intended for describing the technical solutions of the present disclosure, but not for limiting the present disclosure. Although the present disclosure is described in detail with reference to the foregoing embodiments, persons of ordinary skill in the art should understand that they may still make modifications to the technical solutions described in the foregoing embodiments or make equivalent replacements to some or all technical features thereof, without departing from the scope of the technical solutions of the embodiments of the present disclosure.

What is claimed is:

1. A method for improving speaker performance, comprising:

obtaining an identity of a speaker by reading an identifier on the speaker, wherein the identifier includes a first pin on the speaker and a second pin on the speaker, wherein the first pin is grounded, wherein the speaker includes a metal speaker box housing that houses the speaker, wherein the metal speaker box housing is used as the first pin, and wherein a short-circuit connection between the first pin and the second pin is used to obtain the identity of the speaker;

obtaining an algorithm parameter corresponding to the speaker from a preset algorithm parameter library according to the identity of the speaker, wherein the preset algorithm parameter library comprises algorithm parameters of speakers of at least two models; and sending the algorithm parameter corresponding to the speaker to a smart speaker power amplifier, so that the smart speaker power amplifier drives the speaker according to the algorithm parameter corresponding to the speaker.

2. The method according to claim 1, wherein the second pin is connected to a voltage of 1.8 volts.

3. A terminal device, comprising:

a smart speaker power amplifier;

an application processor;

a memory coupled to the application processor;

a speaker coupled to the smart speaker power amplifier, wherein the speaker includes a metal speaker box housing that houses the speaker; and an identifier disposed on the speaker and configured to identify the speaker, wherein the identifier includes a first pin on the speaker and a second pin on the speaker, wherein the first pin is grounded, wherein the metal speaker box housing is used as the first pin, wherein the memory is configured to store algorithm parameters of speakers of at least two models;

wherein the application processor is configured to:

read information about the identifier to obtain an identity of the speaker, wherein a short-circuit connection between the first pin and the second pin is used to obtain the identity of the speaker;

obtain, according to the identity, an algorithm parameter corresponding to the speaker from the memory; and send the corresponding algorithm parameter to the smart speaker power amplifier, and wherein the smart speaker power amplifier is configured to drive the speaker according to the algorithm parameter sent by the application processor.

4. The terminal device according to claim 3, wherein the second pin is connected to a voltage of 1.8 volts.

5. The terminal device according to claim 3, wherein the terminal device is a mobile phone.

6. A terminal device, comprising:

a smart speaker power amplifier;

an application processor;

a memory coupled to the application processor;

a speaker coupled to the smart speaker power amplifier, wherein the speaker includes a metal speaker box housing that houses the speaker;

a pin disposed on the speaker; and a resistor disposed on the speaker and electrically connected to the metal speaker box housing and the pin, wherein the metal speaker box housing is grounded, wherein the memory is configured to store algorithm parameters of speakers of at least two models, wherein the application processor is configured to:

determine an identity of the speaker by determining a resistance value of the resistor using the pin and the metal speaker box housing;

obtain, from the memory and according to the identity, an algorithm parameter corresponding to the speaker; and send the algorithm parameter to the smart speaker power amplifier, and wherein the smart speaker power amplifier is configured to drive the speaker according to the algorithm parameter sent by the application processor.

7. The terminal device of claim 6, further comprising:

a metal support within the terminal device; and conductive foam, wherein the metal speaker box housing is connected to the metal support via the conductive foam, and wherein the metal speaker box housing is grounded by the connection to the metal support.

8. The terminal device of claim 6, wherein the metal speaker box housing is formed of a steel sheet material.

* * * * *